United States Patent [19]

Cretzmeyer, III

[11] Patent Number: 4,580,405

[45] Date of Patent: Apr. 8, 1986

[54] BEVERAGE COOLING DEVICE AND METHOD FOR USING SAME

[76] Inventor: Francis X. Cretzmeyer, III, 2002 9th Street Pl., Coralville, Iowa 52241

[21] Appl. No.: 732,595

[22] Filed: May 10, 1985

[51] Int. Cl.[4] ..... F25D 13/06

[52] U.S. Cl. ..... 62/63; 62/381; 62/457

[58] Field of Search ..... 62/457, 371, 372, 530, 62/381, 62, 63

[56] References Cited

U.S. PATENT DOCUMENTS 4,078,397 3/1978 Brande ..... 62/457 X 4,164,851 8/1979 Bryant ..... 62/457 X

*Primary Examiner*—Lloyd L. King

*Attorney, Agent, or Firm*—Zarley, McKee, Thomte, Voorhees & Sease

[57] ABSTRACT

The beverage cooling device of the present invention comprises an ice receptacle having an ice compartment therein and having an open upper end. An electric motor having an outlet shaft thereon is mounted in a track on the exterior of one of the walls of the receptacle and is free to move upwardly and downwardly within the track. The output shaft extends through a shaft opening in the side wall of the ice receptacle, and includes a suction cup for detachably grasping the container for the beverage. Actuation of the electric motor causes the beverage container to rotate and to frictionally engage ice within the ice receptacle.

5 Claims, 7 Drawing Figures

BEVERAGE COOLING DEVICE AND METHOD FOR USING SAME

BACKGROUND OF THE INVENTION

This invention relates to a beverage cooling device and a method for using the same. Many beverages are sold in containers at the grocery store. Often these containers are uncooled, and therefore it is necessary for the consumer to cool the container and the beverage therein before serving it.

The conventional way of cooling such beverages is to place them in a refrigerator until they have been sufficiently cooled for serving. However, this takes a considerable length of time.

Therefore, a primary object of the present invention is the provision of an improved beverage cooling device and method for using same.

A further object of the present invention is the provision of a beverage cooling device which will cool the beverage in less time than prior beverage cooling devices.

A further object of the present invention is the provision of a beverage cooling device which is simple in construction and which operates reliably.

A further object of the present invention is the provision of a beverage cooling device which can cool the beverages one container at a time.

A further object of the present invention is the provision of a beverage cooling device which places the beverage container in contact with ice and which rotates the beverage container so as to maximize the heat exchange between the ice and the beverage.

A further object of the present invention is the provision of a beverage cooling device which utilizes ice, and which adjusts its position relative to the ice throughout the melting of the ice.

A further object of the present invention is the provision of a beverage cooling device which can be attached to beverage containers of various shapes and sizes.

A further object of the present invention is the provision of a beverage cooling device which is simple to attach to a beverage container and which can be easily removed from the beverage container.

A further object of the present invention is the provision of a device which is economical to manufacture, durable in use and efficient in operation.

SUMMARY OF THE INVENTION

The present invention utilizes an ice receptable which includes side walls, a bottom wall, and an open upper end. One wall of the ice receptacle includes an elongated vertical slot therein and also includes a vertical track mounted on the outer surface thereof.

A power pack includes an electric motor which may be either AC or DC and which includes an output shaft adapted to rotate in response to the actuation of the motor. The power pack includes track following members thereon which are adapted to fit within the track on the outer surface of the receptacle walls.

The power pack is mounted in the track for sliding movement vertically therein, with the output shaft of the motor extending through the elongated slot and into the interior of the receptacle.

A rubber suction cup is attached to the output shaft and is adapted to be detachably mounted to the end wall of a cylindrical beverage container. Actuation of the power pack cause the cylindrical beverage container to rotate at the same speed as the output shaft.

In operation, the receptacle is filled approximately two-thirds full with ice which is either in cubes or crushed.

The power pack is then attached to the beverage container be means of the suction cup. The beverage container and the power pack are then fitted into the elongated track on the exterior of the receptacle wall. The beverage container is within the receptacle and rests upon the ice in the receptacle. The power pack is outside the receptacle, and the output shaft of the power pack extends through the slot into the receptacle where it is attached to the beverage container.

The power pack is actuated which causes the beverage container to rotate or spin in frictional engagement with the ice. This spinning action causes a maximization of the heat transfer between the ice and the beverage container. The track allows the power pack to lower in response to the melting of the ice, and at the same time, keeps the beverage container and the power pack level in a straight line with each other.

The device will work satisfactorily with cans or bottles or other types of cylindrical containers.

DETAILED DESCRIPTION OF THE PREFERRED EMBODIMENT

Figure 1:
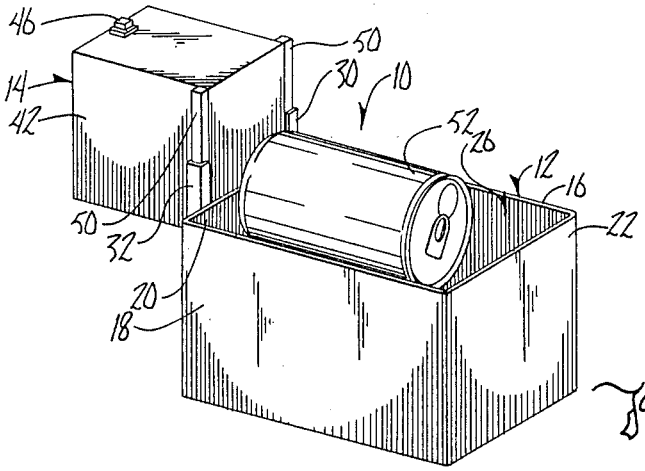
FIG. 1 is a perspective view of the present invention.

Referring to the drawings, the numeral 10 generally designates the cooling device of the present invention. Device 10 includes an ice receptacle 12 and a power pack assembly 14. Receptacle 12 includes a pair of side walls 16, 18, end walls 20, 22 and a bottom wall 24. Walls 16–22 form an open end 26 at their upper edges.

Figure 5:
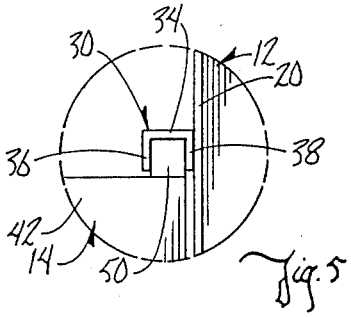
FIG. 5 is an enlarged detail taken along line 5—5 of FIG. 3.
Figure 2:
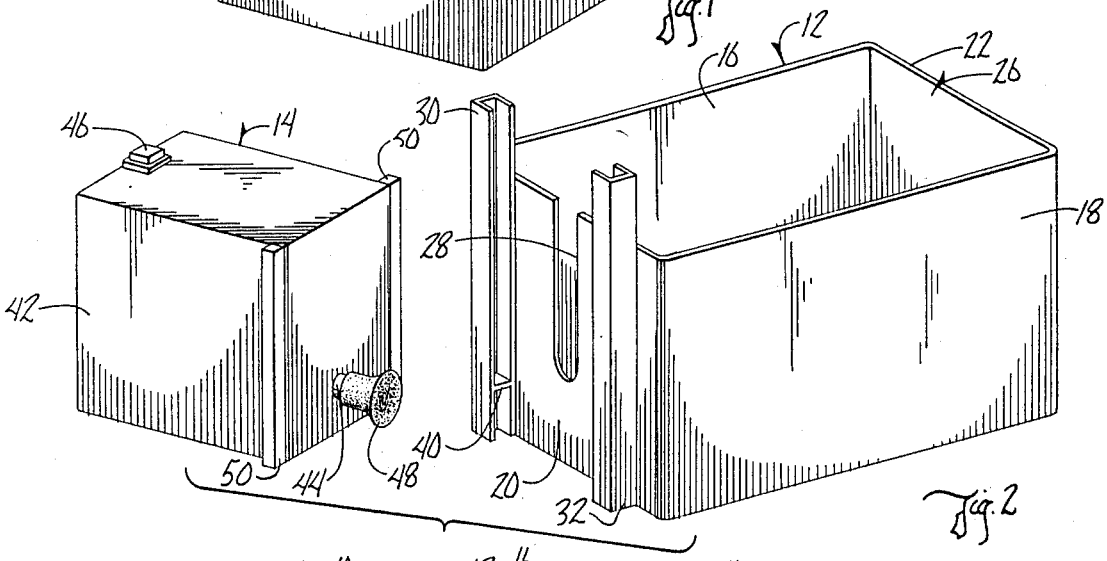
FIG. 2 is an enlarged perspective view of the present invention showing the power pack separate from the ice receptacle.
Figure 3:
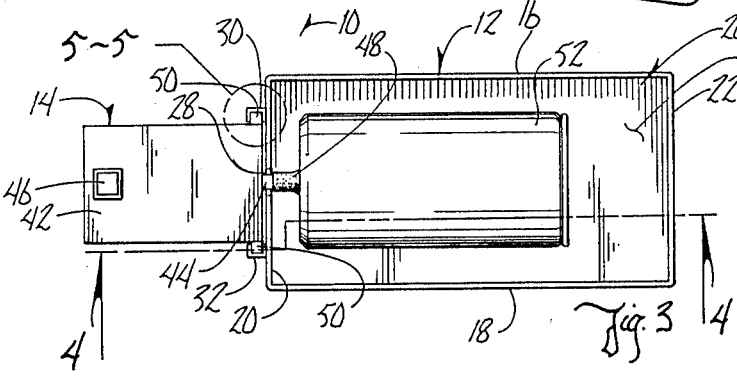
FIG. 3 is a top plan view of the invention with a beverage container attached to the power pack.

End wall 20 is provided with an elongated vertical slot 28. Also mounted on the exterior surface of end wall 20 are a pair of track members 30, 32, each of which are U-shaped in cross-section and include a web 34 and two U-legs 36, 38 (FIG. 5). A stop flange 40 is provided adjacent the lower end of each of the track members 30, 32.

Power pack 14 comprises a power pack housing 42 which contains an electric motor and reduction gears (not shown) for rotating an output shaft 44. The motor within housing 42 may be either a DC motor or an AC motor as preferred. An actuation switch 46 is provided on the exterior of housing 42 for actuating and deactuating the electric motor therein.

Mounted on the end of shaft 44 is a suction cup 48. Also mounted on housing 42 are a pair of ribs 50 which function as track followers and which are adapted to ride within the U-shaped track members 30, 32.

In operation the beverage container 52 is mounted to power pack 14 by means of suction cup 48 which preferably engages the container 52 at its end wall, with output shaft 44 being aligned with the cylindrical axis of beverage container 52. Thus actuation of power pack 14 causes rotation of shaft 44 and correspondingly causes rotation of beverage container 52 about its longitudinal cylindrical axis.

Receptacle 12 is filled approximately two-thirds full with crushed ice or with ice cubes. Then the ribs 50 are fitted within the tracks 30, 32 so as to mount the power pack 14 and the container 12 in the position shown in FIGS. 1 and 6. In this position, the output shaft 44 is in registered alignment with slot 28 of receptacle 12 so that it can move freely vertically upwardly and downwardly therein. The beverage container 52 is resting upon the ice within receptacle 12.

After the power pack has been placed in the tracks 30, 32, the power pack is then actuated to cause rotation of the beverage container 52. The vertical tracks 30, 32 hold the power pack housing 42 against rotational movement, thereby causing the beverage container 52 to be rotated or spun about its longitudinal axis. This causes frictional sliding movement between the ice 54 and the beverage container 52, thereby maximizing the heat exchange between the two and causing cooling of the beverage within the container 52.

Figure 6:
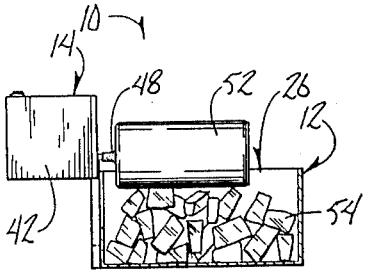
FIG. 6 is a sectional view illustrating the use of the device prior to the time that the ice has begun melting.
Figure 4:
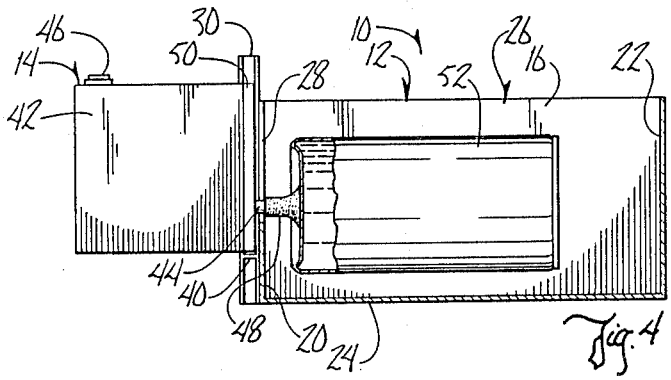
FIG. 4 is a sectional view taken along line 4—4 of FIG. 3.
Figure 7:
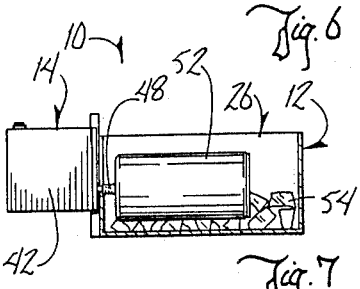
FIG. 7 is a view similar to FIG. 6 showing the position of the device after the ice has melted substantially.

As the ice melts, the weight of the power pack 42 and the beverage container 52 cause downward movement of the power pack housing within the tracks 30, 32 from the position shown in FIG. 6 to the position shown in FIG. 7. This ability to move downwardly permits the beverage container 52 to stay in frictional engagement with the ice 54, thereby insuring full transfer of heat from the beverage container to the ice.

The present invention has been found capable of chilling canned beverages from room temperature to approximately 50° F. in one to three minutes. The device also is capable of being attached to a bottle or other cylindrical container for cooling the beverage therein. The device is simple in construction and efficient in operation.

Thus, it can be seen that the device accomplishes at least all of its stated objectives.

What is claimed is:

1. A method for cooling a beverage in a cylindrical beverage container having opposite axial container ends and a cylindrical wall; said method comprising:

placing ice in an ice receptacle having side walls, end walls, and a bottom wall defining an ice compartment, said ice compartment having an open upper end;

attaching one of said axial ends of said container to a suction cup on the output shaft of an electric motor whereby actuation of said motor causes rotation of said beverage container about its cylindrical axis, said motor having a housing, placing said beverage container within said ice compartment resting upon and in frictional engagement with said ice with said housing of said power means being outside said ice receptacle and with said output shaft extending to said suction cup and said beverage container through a shaft opening in one of said walls of said receptacle;

actuating said motor to cause rotational movement of said beverage container with respect to said ice whereby the frictional engagement of said beverage container with respect to said ice will cause cooling of said beverage within said container.

2. A method according to claim 1 comprising mounting of said housing of said power means in a vertical guide means on the outside surface of said ice receptacle for permitting said motor to move vertically from an upper position to a lower position; whereby said beverage container and said motor are permitted to settle vertically in response to the melting of said ice within said receptacle during rotation of said beverage container in frictional engagement with said ice.

3. A device for cooling a beverage in a cylindrical beverage container having opposite axial container ends and a cylindrical wall, said cooling device comprising:

an ice receptacle having side walls, opposite end walls, and a bottom wall defining an ice compartment, said compartment having an open upper end, all of said receptacle walls having inner and outer surfaces, an electical motor having a housing and a rotatable output shaft;

a shaft opening in one of said walls of said receptacle for receiving said output shaft of said motor;

coupling means for coupling said housing of said motor to the outside surface of said one wall of said receptacle with said output shaft extending through said shaft opening into said ice compartment;

attachment means on said output shaft for attaching said output shaft to said beverage container whereby actuation of said motor will cause said output shaft to rotate said beverage container, said attachment means comprising a suction cup on the end of said output shaft for retentively engaging one of said opposite axial ends of said container.

4. A device according to claim 3 wherein said coupling means comprises a track and a track follower, one of said track and track follower being on the outside surface of said one receptacle wall and the other of said track and track follower being on said housing of said motor, said track and track follower permitting vertical movement of said motor with respect to said ice receptacle from an upper position to a lower position.

5. A device according to claim 4 wherein said shaft opening comprises an elongated vertically disposed slot for permitting vertical movement of said output shaft during movement of said motor from said upper position to said lower position.

* * * * *